United States Patent [19]

Maupin et al.

[11] Patent Number: 4,653,292

[45] Date of Patent: Mar. 31, 1987

[54] EARRING KIT

[76] Inventors: Judy Maupin; Elizabeth G. Maupin, both of P.O. Box 202, Loveland, Ohio 45140

[21] Appl. No.: 737,707

[22] Filed: May 28, 1985

[51] Int. Cl.[4] ..... A44C 7/00

[52] U.S. Cl. ..... 63/12; 24/104

[58] Field of Search ..... 63/12, 13, 29 R; 24/103, 104, 108

[56] References Cited

U.S. PATENT DOCUMENTS

| | | | |
|---|---|---|---|
| 148,390 | 3/1874 | Tappan | 63/13 |
| 229,080 | 6/1880 | Ballou | 63/13 X |
| 483,214 | 9/1892 | Gaynor | 63/13 X |
| 3,071,938 | 1/1963 | Davidson | 63/13 |
| 3,088,295 | 5/1963 | Haines | 63/29 R |
| 3,260,068 | 7/1966 | Micallef | 63/12 |
| 3,418,826 | 12/1968 | Wieshuber | 63/13 |
| 3,533,247 | 10/1970 | Douglas | 63/14 |
| 3,698,044 | 10/1972 | Chernow | 24/108 |
| 4,221,118 | 9/1980 | Chicckine | 63/13 |

FOREIGN PATENT DOCUMENTS

| | | | |
|---|---|---|---|
| 660 | 12/1899 | Austria | 24/108 |
| 759383 | 10/1956 | United Kingdom | 63/12 |

*Primary Examiner*—Richard J. Johnson

[57] ABSTRACT

An earring kit is provided to allow the user to assemble an ornamental earring combination comprising as discrete members and an ear penetrating post, a post clamp and a decorative member. Various decorative members such as buttons are provided for interchangeability in use in combination with the ear penetrating posts and post clamps which are also provided.

3 Claims, 4 Drawing Figures

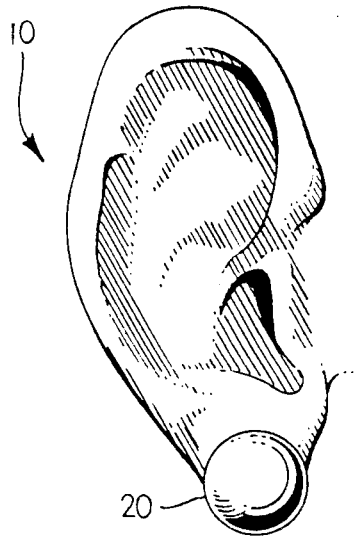
Fig 1
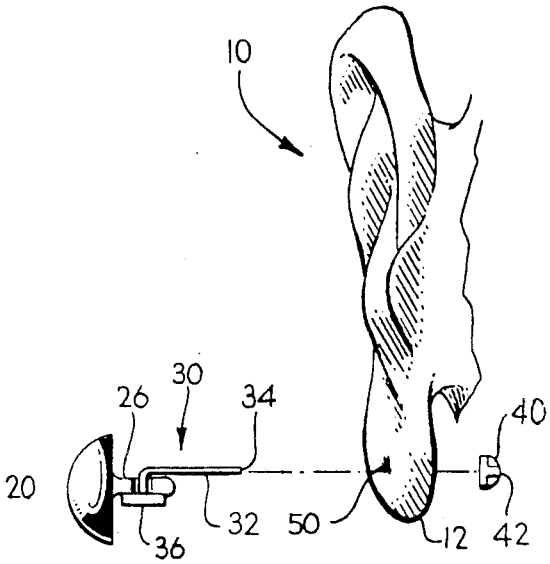
Fig 2
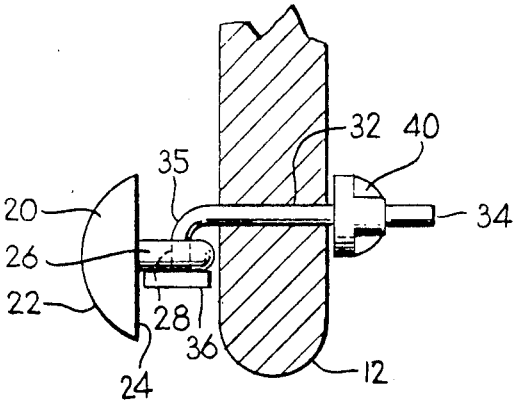
Fig 3
Fig 4
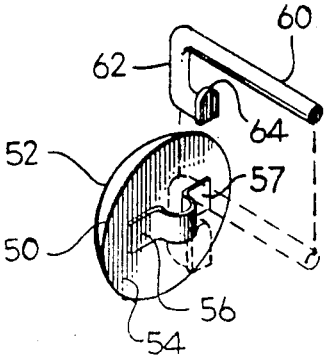

EARRING KIT

BACKGROUND OF THE INVENTION

1. Field of the Invention

This invention relates generally to an earring kit and more particularly to an earring kit designed to provide a variety of decorative members suitable for interchangably attaching to an earring holder or post, particularly for earrings for use in pierced ears.

2. Description of the Prior Art

Various decorative and ornamental earrings have been designed and are known in the art for use with either pierced or non-pierced ears. A pierced ear is one wherein the earlobe is punctured or pierced so that a post or the like may be inserted therein to hold the earring of the user.

Early Prior Art pierced earrings have provided either a one or two-piece earring. The two-piece earring has a straight shank portion with a decorative member permanently attached at the first end thereof. The shank portion is designed first to be inserted through the pierced ear and then to accept a slidably attached holder, stay or clutch mechanism designed to hold the earring in position in the ear of the user. Such an earring and clutch mechanism is shown by Chernow in U.S. Pat. No. 3,698,044.

The one piece earring such as that shown by Micallef in U.S. Pat. No. 3,260,068, generally provided an earring with a decorative member at a first end with a shank portion attached thereto and extending therefrom. The shank has a first portion extending at a substantially right angle from the decorative portion and a second portion substantially at right angles to the first portion for insertion into the pierced ear of the user and acting as the inner brace to hold the earring in place.

A later design, Chicckine, U.S. Pat. No. 4,221,118, provides an earring holder for use with pierced ears and includes a serpentine rod for insertion into a pierce ear. The serpentine rod loosely carries and allows for addition of different decorative members at the discretion of the user.

Douglas in U.S. Pat. No. 3,533,242 and Wieshuber in U.S. Pat. No. 3,418,826 disclosed the use of earrings having interchangeable parts.

The present invention provides an earring kit for use with pierced ears wherein the user can easily change the decorative member of the pierced earring at will using a variety of common items such as buttons or more expensive items specifically designed for the earring of the present invention, while maintaining a comfortable, easily useable and inexpensive earring.

SUMMARY OF THE INVENTION

A primary object of the invention is to provide an ornamental earring combination suitable for use with pierced ears.

A second object of the invention is to provide a means whereby the decorative portion of the earring combination may be changed frequently at the user's discretion.

Another object of the invention is to provide an earring kit wherein various interchangable decorative members are provided for the user's selection.

A further object of the invention is to provide an inexpensive means of increasing one's jewelry wardrobe by selection of inexpensive buttons, shields, flowers, other jewelry articles, etc. which may be used as interchangable decorative members of the ornamental earring combination provided.

Still, a further object of the invention is to provide a means for the interchangability of the decorative portion of the ornamental earring combination provided.

Other objects, features and advantages of the invention will be apparent with the following detailed description taken in conjunction with the accompanying drawings showing preferred embodiments of the invention.

The present invention, in one form, provides an ornamental earring combination which comprises an ear penetrating post, a post clamp and a decorative member. The decorative member is designed to slidably mount the ear penetrating post which has, in series, an end portion, a rigid shank and an enlarged head portion at another end thereof, non-linear with the shank. The head portion is adapted to cooperate with an inner portion of the decorative member to releasably hold together the decorative member and the post while a post clamp is mounted at the opposite end of the post to secure the post within the pierced ear of the user. The present invention allows the user to interchangably mount the decorative member to the post at the user's discretion thereby increasing the user's jewelry wardrobe.

BRIEF DESCRIPTION OF THE DRAWINGS

In the drawings:

FIG. 1 is a view showing the decorative member in use in a pierced ear.

FIG. 2 is an exploded installation view showing the members of the invention in combination.

FIG. 3 is an enlarged cross-sectional view showing the members of FIG. 2 is use in their final combination positions.

FIG. 4 is an exploded installation view showing an alternate embodiment of the invention.

DESCRIPTION OF THE PREFERRED EMBODIMENT

Referring more particularly to the drawing, wherein like numbers refer to like parts in each view, FIG. 1 illustrates a portion of a human ear 10 that has been pierced to enable acceptance of any of a number of earrings designed for use with such pierced ears. A decorative member 20 is shown in place in said ear. It is generally understood and accepted that pierced ears generally contain a penetration channel, such as that shown at 50 in ear portion 12 in FIG. 2. Such a penetration channel is generally a through hole characterized by the absence of skin or other human body material to allow the acceptance of various post or wire portions of pierced earrings designed to variously attach the decorative earrings to the pierced ear. Such an ear penetrating post portion of the present invention is shown at 30 in FIG. 2.

The ear penetrating post 30, has a substantially linear, rigid post shank 32 and a post end portion 34 designed for penetration of penetration channel 50 to allow the post shank 32 to nestle within penetration chanel 50 when the pierced earring is in position. Ear penetrating post 30 further comprises an enlarged head 36 which includes a neck portion 35, in the embodiment shown in FIG. 3, substantially at a right angle to post shank 32.

Accordingly, enlarged head 36 is non-linear with post shank 32 and is adapted to cooperate with an inner portion 26, FIG. 3, of decorative member 20. Post head 36, disposed at an angle to the shank 32, is connected to the shank at a neck end of neck portion 35 between the shank 32 and head 36.

Neck portion 35 is formed by application of any of a number of known state of the art forming mechanisms applied to the substantially linear ear penetrating post 30. The enlarged head 36 may be applied to the end of neck portion 35 by application of a number of joining techniques currently known in the jewelry industry such as brazing, soldering, welding, etc. or it may be formed integrally by a technique of metal deformation such as spinning, explosive forging or the like.

To complete the pierced earring combination of the present invention a decorative member 20 is used in combination with ear penetrating post 30 and post clamp 40, FIGS. 2 and 3. Post clamp 40, in the embodiment shown, has an interior opening 42 configured to accept the post shank end portion for holding the earring combination in the users ear. Decorative member 20 includes outer portion 22, and inner portion 24, FIG. 3. Inner portion 24 includes a protrusion 26 having an opening 28 therethrough, the opening being smaller than the head 36 and larger than the shank 32. Opening 28 is configured to allow passage of the post shank 32 and at least a portion of neck 35 up to but not including head 36.

The present invention will thus allow the application of various decorative members 20, to ear penetrating posts 30 to be used in combination therewith and in combination with post clamp 40 to form a completed pierced earring unit for use with pierced ears. The decorative members 20 may be selected from a variety of available decorative members such as buttons, shields, flowers, or other items of a decorative nature, allowing the user to increase a jewelry wardrobe at a minimum of expense. Ear penetrating post 30 may be of any of the following standard pierced earring post materials such as gold, silver, platinum, surgical steels and the like or of a variety of materials coated with plastic or similar materials which are hygenically or septically pure and will not tend to cause infection of the ear of the user.

Ideally the present invention can be packaged and marketed in kit form wherein a number of ear penetrating posts 30 with an equal number of post clamps 40 are provided with a greater number of decorative members 20 provided in matching pairs. Such decorative members 20 provided, can be any of a number of decorative items previously mentioned, but not limited thereto, from inexpensive items to very expensive items, as desired.

An alternate embodiment of the present invention is shown in FIG. 4, wherein the decorative member 50, is provided with an outer portion 52 and an inner portion 54. Attached to said inner portion is a biasing means 56, such as a spring clamp, designed and configured to receive a post head of the present invention or more ideally to accept a post head containing a hook portion 62 with a hook lip 64 at the end thereof. Said biasing means 56, is designed and configured to receive the post head or hook portion 62 and releaseably hold the post head at the inner portion utilizing hook lip 64. For example, in the embodiment shown in FIG. 4, one end of biasing means or spring clip 56 can be bonded to inner portion 54, leaving the other end free to spring away from inner portion 54. Shank 60 through end portion 62 and 64 as described is designed to move a portion on edge 57 of clip 56 away from inner portion 54, penetrate therethrough, and snap into biasing means or spring clamp 56 of the alternate embodiment when edge 57 springs back toward inner portion 54, subsequently to be used in combination with ear portion 12 and post clamp 40 as shown in FIG. 3.

It is understood that the invention is not confined to the particular construction, materials, and arrangement of parts herein illustrated and described. Instead, it embraces all such modified forms thereof as should be obvious to those skilled in the art. The invention embraces all modified forms that come within the scope of the following claims.

We claim:

1. An ornamental earring combination consisting essentially of three discrete members readily separable from one another;

a rigid ear penetrating post;

a post clamp; and a decorative member;

the post having a retaining head including a neck extending at a generally right angle from and rigidly connected to the retaining head, an end portion, and a rigid shank disposed along a substantially linear axis and rigidly connected between the neck and the end portion;

the neck portion being disposed substantially at a right angle to and rigid with the shank whereby the retaining head is positioned away from the linear axis of the shank;

the retaining head and neck being adapted to cooperate with an inner portion of the decorative member;

the end portion being adapted to penetrate an ear portion and the post clamp;

the post clamp constructed to receive the end portion and the shank and to releaseably clamp about the shank;

the decorative member including a decorative outer portion and an inner loop portion having a generally vertically oriented opening adapted to receive and cooperate with the neck portion and the retaining head to releasably hold together the decorative member and the post.

2. The earring combination of claim 1 in which:

the post clamp has an opening therethrough to receive the post end portion;

the retaining head comprises an enlarged head end disposed at an angle to the shank and connected to the shank at said neck between the shank and the head; and the decorative member inner portion includes a protrusion having an opening therethrough smaller than the head end and configured to allow passage of the post shank and at least a portion of the neck up to but not including the head end.

3. The earring combination of claim 1 in which:

the retaining head comprises a hook-shaped portion disposed substantially at a right angle to the shank and rigid therewith; and the decorative member inner portion includes a biasing means openable to receive and resiliently hold the hook-shaped portion at the inner portion.

* * * * *